United States Patent [19]

Moeller

[11] Patent Number: 4,854,354

[45] Date of Patent: Aug. 8, 1989

[54] DOSING ARRANGEMENT INCLUDING A RETURN SUCKING DEVICE

[75] Inventor: Dieter Moeller, Haan, Fed. Rep. of Germany

[73] Assignee: Benz & Hilgers GmbH, Duesseldorf, Fed. Rep. of Germany

[21] Appl. No.: 75,378

[22] Filed: Jul. 20, 1987

[30] Foreign Application Priority Data

Jul. 21, 1986 [DE] Fed. Rep. of Germany ..... 3624592

[51] Int. Cl.[4] ..... B65B 3/32

[52] U.S. Cl. ..... 141/116; 141/311 A; 141/258; 141/86; 137/312; 222/108

[58] Field of Search ..... 141/115-125, 141/311 A, 86, 255, 258, 259, 260, 261; 222/108, 490; 137/312

[56] References Cited

U.S. PATENT DOCUMENTS

| | | | |
|---|---|---|---|
| 2,779,506 | 1/1957 | Gajda | 141/116 X |
| 3,066,830 | 12/1962 | Heiss et al. | 141/117 X |
| 3,351,250 | 11/1967 | West | 141/117 X |
| 3,463,203 | 8/1969 | Wolf | 141/116 X |
| 3,874,430 | 4/1975 | Landsdale | 141/116 |
| 4,230,160 | 10/1980 | Buckley | 141/116 |
| 4,254,806 | 3/1981 | Elsworth | 141/116 |
| 4,676,279 | 6/1987 | von Lersner | 141/125 X |

FOREIGN PATENT DOCUMENTS 2107828 8/1972 Fed. Rep. of Germany .

*Primary Examiner*—Ernest G. Cusick
*Attorney, Agent, or Firm*—Klein & Vibber

[57] ABSTRACT

The invention relates to a dosing arrangement for filling of liquid nutrient materials, in particular salad-like products having solid, respectively chunky constituents, whereby a cylinder-piston-unit is mounted for a return sucking operation substantially in the immediate vicinity of the outlet end of a mouthpiece, respectively a mouthpiece chamber. Thereby an undesirable postdripping is prevented also during the filling of liquid containing products having solid constituents. In particular this effect is achieved by providing the mouthpiece with a return sucking cylinder connected thereto at its lower end by way of a conical communication channel and a transfer piece for receiving at least a slitted sealing membrane or the like sealing element.

8 Claims, 3 Drawing Sheets

DOSING ARRANGEMENT INCLUDING A RETURN SUCKING DEVICE

BACKGROUND OF THE INVENTION

The invention relates to a device for filling nutrient materials, in particular liquid food products which include solid, chunky pieces and a suitable dosing arrangement therefore. Such device includes a housing with a material inlet, a mouthpiece as well as a dosing element which includes an inlet and outlet valve that is independently adjustable as well as a return sucking device.

Dosing arrangements for feeding products at a right angle to the dosing arrangement are already known in the state of the art. In such a known arrangement the dosing element is mounted laterally above the outlet end of the mouthpiece. There is mounted in a plane above the dosing element vertically above the mouthpiece a return sucking piston of the return sucking arrangement.

By a corresponding adjustment of the return sucking piston there is assured that at the outlet end of the mouthpiece a postdripping of the product is prevented, because otherwise problems with respect to the soiling of the machine and eventually problems with the sealing of the container which is to receive the nutrient material cannot be avoided. It has now been demonstrated that such dosing arrangements with return sucking of the above-described type work generally quite well as long as they are used for a pasty type of nutrient material, for example materials which contain mayonnaise.

However, when such a machine is used for filling products which contain different solid, respectively chunky constituents, such as for example onions, sauerkraut, paprika, etc. within a large quantity of liquid, such as for example sauce, gravy, broth or the like, it has been demonstrated that such salad-like filling products can no longer operate with the known dosing arrangement without any post-dripping occurring. This can be particularly attributed to the fact that the return sucking piston is relatively far removed from the outlet end of the mouthpiece, so that the sucking force is no longer effective to prevent the post-dripping of the product. In addition to this drawback, it has been noted that in this type of dosing arrangement a relatively large quantity of liquid collects between the dosing element and the mouthpiece, so that consideration has to be given as to how one could better prevent the post-dripping of such a device.

In practice there are already known dosing arrangements wherein the outlet end of the mouthpiece is provided with membrane-like sealing elements. These arrangements generally operate satisfactorily with respect to the post-dripping problem. However, by operating with products of the afore-described type it is not always possible to avoid a clogging by the solid constituents in the opening of the sealing membrane and thereby prevent an effective sealing, respectively drip-free closing of the closing membrane.

SUMMARY OF THE INVENTION

It is an object of this invention to provide a dosing arrangement of the afore-described type by means of which the post-dripping, above all with devices operating with large liquid quantities of salad-like products which have solid constituents, can be absolutely avoided in a simple manner and with a simple construction.

This object is achieved with the device of this invention by mounting the return sucking device essentially directly in the region of the outlet end of the mouthpiece.

By so mounting the return sucking device in the region of the outlet end of the mouthpiece, and by obtaining thereby an improved sucking effect, there is obtained an effective means, also with products having solid constituents, for substantially avoiding any undesirable post-dripping, which would otherwise lead to soiling the machine and to problems in sealing the to be filled container.

Advantageously, the return sucking cylinder with the return sucking piston is mounted laterally relative to the housing with an adjusting arrangement, for example, in a manner whereby the axis of the return sucking cylinder, respectively return sucking piston, and of an adjusting cylinder, respectively an adjusting piston of the adjusting arrangement, is arranged substantially parallel to the transport direction for the product inlet of the product used for filling. This inlet extends within the housing in the transport direction towards the mouthpiece. In this way there is attained the particular advantage that the product is filled from the product inlet up to the outlet at the mouthpiece in a fully linear manner, that is a product stream is achieved which has no deviations or deflections which would in generally inhibit the transporting of the product.

There has now been demonstrated that the post-dripping can be easily avoided in each case when the return sucking cylinder is flanged on its lower end on a transfer member which is provided with a conical shaped communication channel for the chamber of the mouthpiece. This transfer member is constructed to receive at least one sealing membrane or the like sealing element. In this manner one obtains a double effect that is, the very proximate arrangement to the mouthpiece and thereby good efficacy of the return sucking piston, and on the other hand, a sealing effect is achieved by means of the sealing membrane respectively membranes. In the event any solid constituents of the to be filled salad-like products is caught in the openings of the sealing membrane or sealing membranes, respectively are hung-up therein. They are immediately sucked out by means of the effect of the return sucking piston and with a particularly large sucking effect, so that a postdripping is completely avoided. This effect is enhanced when the sealing membrane, respectively membranes, is mounted at a small distance from the outlet valve.

The afore-described constructional arrangements of the return sucking device and the sealing device at the mouthpiece do not prevent an eventual cleaning of the dosing arrangement. This is the case because the transfer member is provided with a dove-tail guide member, and with a corresponding dove-tail-guiding along guide rails mounted in the housing thereby making the arrangements laterally transversely slidable.

In order to assure that a product filling occurs always only when the sealing arrangement and the return sucking arrangement are in their operative positions, the return sucking cylinder has advantageously a control mechanism for an adjusting arrangement which is provided with a switch and a coacting ring-band or collar.

BRIEF DESCRIPTION OF THE DRAWINGS

With these and other objects in view, which will become apparent in the following detailed description, the present invention, which is shown by example only, will be clearly understood in connection with the accompanying drawing, in which.

DESCRIPTION OF THE PREFERRED EMBODIMENT

Figure 1:
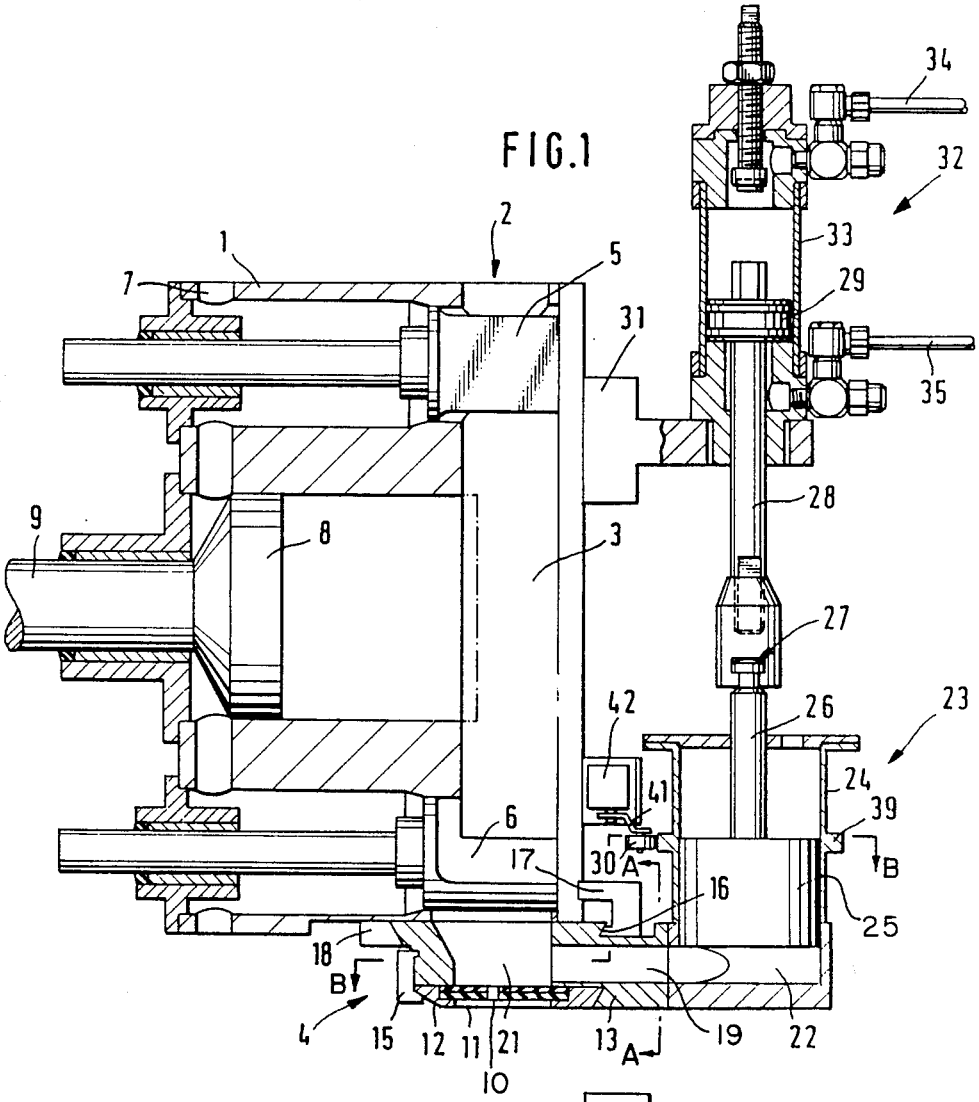
FIG. 1 is a vertical cross-section through a dosing arrangement of the invention having a return sucking device.

As can be noted from FIG. 1, the dosing arrangement has a housing 1 and a product inlet 2, a transport conduit or a feed channel 3 extending vertically within the housing 1, as well as a sealing device which is provided with a mouthpiece 4. Moreover, there is disposed in the region of the product inlet 2 a rotatable inlet valve 5 as well as above the mouthpiece 4 a rotatable outlet valve 6. The inlet and the outlet valves 5 and 6 can be brought into a rearward retracted position for purposes of cleaning. In this position, a cleaning fluid can be introduced into the housing 1 via a cleaning fluid inlet 7. There is disposed centrally with respect to the transport conduit 3 and parallel to the axis of the inlet and outlet valves 5 and 6, an axial displaceable dosing piston 8. The dosing piston 8 is provided with a piston rod 9 and is slidably guided within the housing 1.

The sealing device is constructed by means of two sealing members 11 which are closely spaced from the outlet valve 6 and are provided with slits 10, which sealing membranes 11 are exchangeably mounted in a transfer piece 13 via a sealing plate 12. The sealing plate 12 is detachably mounted by means of a pressure strip 15 on the transfer piece 13. This transfer piece 13 has a dove-tailed-guide groove 16, which coacts with corresponding dove-tailed portion of the guide rail 17, so that the transfer piece 13 is laterally transversely slidable.

Figure 2:
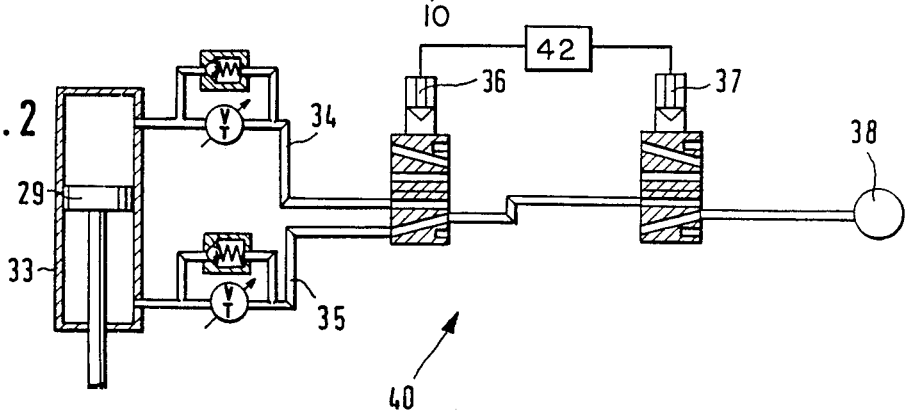
FIG. 2 is a control device for an adjusting arrangement of the return sucking device.
Figure 3:
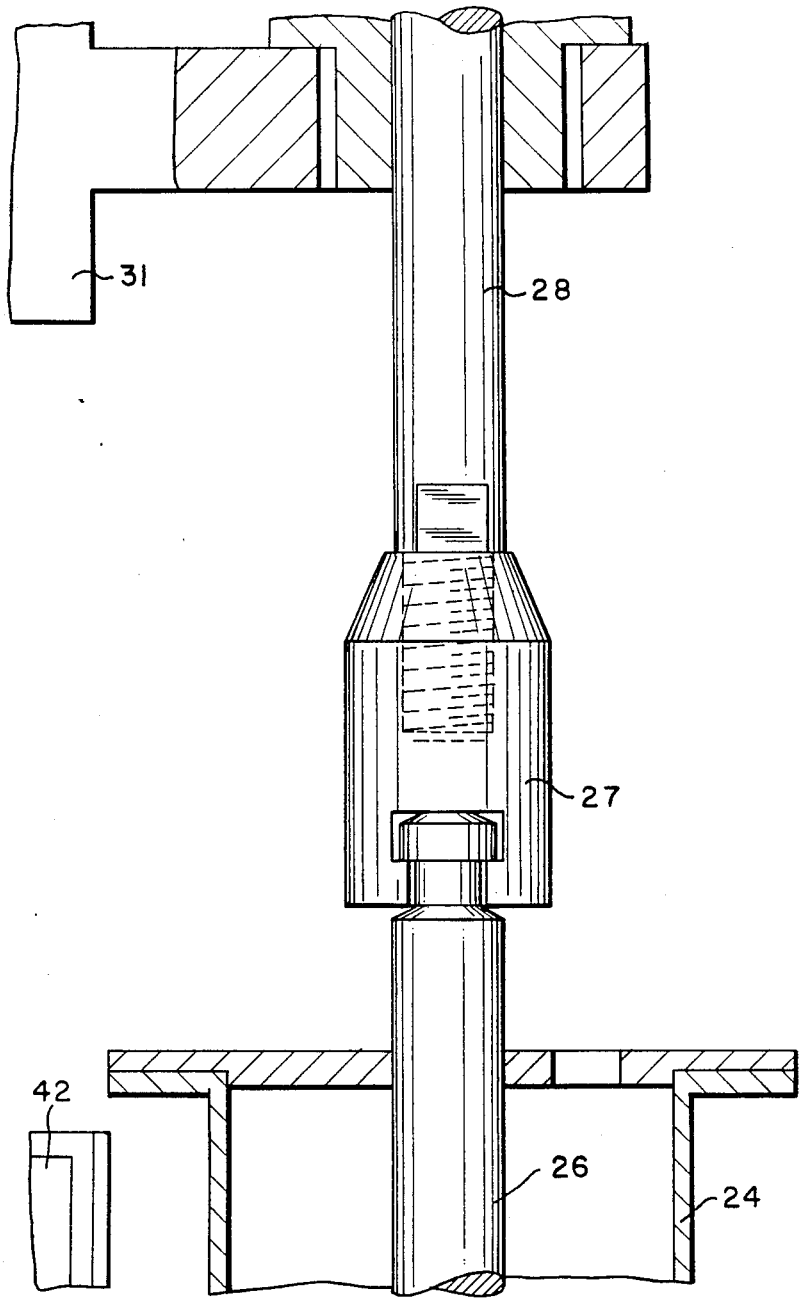
FIG. 3 is an enlarged side-elevational view of the coupling between the two piston rods of the dosing arrangement of the invention.
Figure 5:
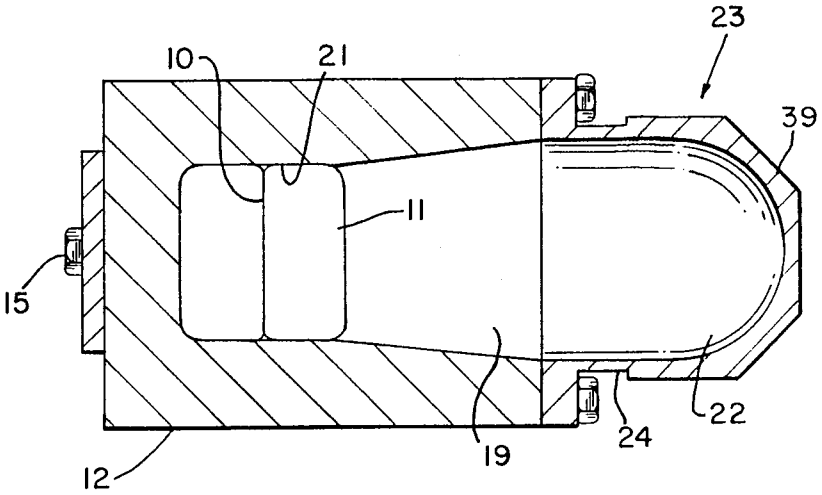
FIG. 5 is a cross-sectional view along line A—A of FIG. 1.
Figure 4:
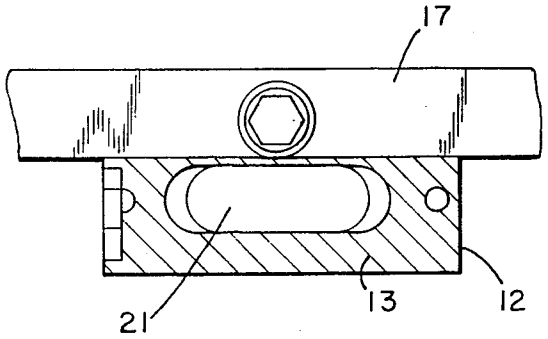
FIG. 4 is a cross-sectional view along line B—B of FIG. 1.

The transfer piece 13 is, via a conical communication channel 19, as illustrated in FIGS. 4 and 5, joined, on the one hand, with the mouthpiece chamber 21 and, on the other hand, with a return chamber 22 of a return sucking device 23. This return sucking device 23 consists essentially of a return sucking cylinder 24 and a return sucking piston 25, which by way of a piston rod 26 and a laterally slidable displacement by way of a coupling 27 is joined to the piston rod 28 of an adjusting cylinder 29 of an adjustment arrangement 32 which is fixedly mounted on the housing 1 by way of a support member 31. The adjusting arrangement 32 has, for purposes of guiding the adjusting piston 29, an adjusting cylinder 33 with a stroke adjustment mechanism. The adjusting cylinder 33 is connected to pressure conduits 34, 35, which by means of an intermediate switching carried out by the magnetic valves 36, 37 is connected to a source of pressurized medium, for example a source of pressurized air 38 (see FIG. 2).

There is mounted on the return sucking cylinder 24 a ring band or collar 39 which coacts by way of a roller 30 with a lever 41 of a switch 42.

MANNER OF OPERATION

The dosing arrangement operates as follows:

In order to initiate the filling, it is first of all necessary to slidably displace into the operative position the return sucking device 23 together with the sealing arrangement via the dove-tailed-guide groove 16 along the guide rails 17, 18, that is, in a position wherein the sealing membranes 11 are positioned with the transfer piece 13 in the region of the feed conduit 3 of the housing 1. The switch 42 is then activated by means of the collar 39 and the roller 30 as well as the lever 41, whereby via the latter forming part of a control circuit a pulse is transmitted to the magnetic valve 37 so that the pressure medium, for example pressurized air, is conducted to the magnetic valve 36. The adjusting arrangement 32, respectively the adjusting piston 29 is controlled by means of the magnetic valve 36 at a nonillustrated programmable switching arrangement.

When the filling operation is completed, that is the outlet valve 6 is closed, as is illustrated in FIG. 1, the remaining product is impact-like sucked out of the mouthpiece chamber 21 by the return sucking piston 25 into the return sucking chamber 22. Thereby there is assured that the sealing membranes 11 can close completely so that a postdripping of liquid is securely avoided. During the following filling operation, that portion of the product which is disposed in the return sucking chamber 22, is pushed by the return sucking piston 25, moving downwardly again, into the mouthpiece chamber 21, so that the return sucked portion of the product, together with the product that has been fed by the dosing piston 8 via the feed conduit 3, and the in the meantime opened outlet valve 6 through the sealing membranes 11 which open downwardly by way of the expulsion stroke into a nonillustrated container that is to be filled and is disposed immediately below the mouthpiece.

Although a single embodiment of the invention has been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

I claim:

1. An improved arrangement for filling of liquid nutrient materials into containers, in particular, liquid products having chunky solid constituents, having a housing with a product inlet, a mouthpiece as well as a dosing piston-cylinder unit, and independently controlled inlet and outlet valves, as well as a return sucking device which includes a second piston-cylinder unit, the improvement comprising;

said return sucking device is operatively mounted in said housing adjacent to said mouth piece;

wherein said return sucking device includes a cylinder and a piston reciprocally movably mounted therein, and an adjusting arrangement operatively connected to said return sucking device, said adjusting arrangement and return sucking device being mounted laterally adjacent to said housing.

2. In a dosing arrangement, the improvement as set forth in claim 1, wherein said housing includes a feed channel and inlet valve and an outlet valve operatively mounted in said feed channel, said feed channel extends through said housing from said product inlet to said mouthpiece, said return sucking device and adjusting arrangement being coaxially mounted relative to each other and parallel to said feed channel.

3. In a dosing arrangement, the improvement as set forth in claim 2, including a mouthpiece chamber disposed between said feed channel and said mouthpiece, the lower end of said cylinder of said return sucking device being in communication with said mouthpiece chamber via a transfer piece which has a conically shaped communication channel and which is operatively connected to the lower end of said housing, said transfer piece having sealing membrane means mounted thereon, said sealing membrane means having at least one outlet slit.

4. In a dosing arrangement, the improvement as set forth in claim 3, wherein said sealing membrane means are mounted at a small distance from said outlet valve and are exchangeably mounted on said transfer piece by means of a detachable sealing plate.

5. In a dosing arrangement, the improvement as set forth in claim 4, wherein said transfer piece is provided with a pair of dove-tailed edge portions, said housing is provided with a pair of guide rails at least one of which matingly engages one of said pair of dove-tailed edge portions, whereby said transfer piece is laterally slidably movable relative to said housing along said pair of dove-tailed guide rails.

6. In a dosing arrangement, the improvement as set forth in claim 5, wherein said cylinder of said return sucking device has a radially outwardly extending collar, switching means mounted on said housing for coaction with said collar, and a control circuit operatively connected to said switching means and to said adjusting arrangement for controlling said adjusting arrangement.

7. In a dosing arrangement, the improvement as set forth in claim 6, wherein said adjusting arrangement includes a cylinder and piston reciprocally movably mounted therein, a piston rod extending from said piston of said adjusting arrangement and a piston rod extending from said piston of said sucking device, coupling means connecting said two piston rods while permitting a lateral displacement of said piston rod of said sucking device relative to said piston rod of said adjusting arrangement.

8. An improved arrangement for filling of liquid nutrient materials into containers, in particular, liquid products having chunky solid constituents, having a housing with a product inlet, a mouthpiece including sealing membrane means having at least one outlet slit through which liquid nutrient materials are dispensed in a feed direction as well as a dosing piston-cylinder unit, and independently controlled inlet and outlet valves, as well as a return sucking device which includes a second piston-cylinder unit, the improvement comprising;

said return sucking device includes a sucking channel and is operatively movably mounted in said housing adjacent to said sealing membrane means for sucking remanent liquid nutrient materials laterally away from said feed direction;

said housing includes a feed channel, said inlet and outlet valves being operatively mounted at opposite ends of said feed channel, said sucking channel of said return sucking device being mounted immediately underneath the outlet valve of said feed channel.

* * * * *